United States Patent [19]

Weyer

[11] 4,422,366

[45] Dec. 27, 1983

[54] ROTARY HELICAL ACTUATOR

[76] Inventor: Paul P. Weyer, 48811 284th Ave. SE., Enumclaw, Wash. 98022

[21] Appl. No.: 312,091

[22] Filed: Oct. 16, 1981

[51] Int. Cl.[3] ..... F15B 15/22; F01B 3/00

[52] U.S. Cl. ..... 91/26; 91/408; 92/33

[58] Field of Search ..... 92/33; 91/26, 408, 409; 308/174

[56] References Cited

U.S. PATENT DOCUMENTS

| | | | |
|---|---|---|---|
| 1,056,616 | 3/1913 | Wright et al. | 92/33 |
| 2,292,336 | 8/1942 | Farnham | 91/408 |
| 3,255,806 | 6/1966 | Meyer et al. | 92/33 |
| 3,393,610 | 7/1968 | Aarvold | 92/33 |
| 4,009,639 | 3/1977 | Sabashi | 91/408 |

FOREIGN PATENT DOCUMENTS

| | | | |
|---|---|---|---|
| 1426525 | 5/1969 | Fed. Rep. of Germany | 92/33 |
| 2115707 | 2/1972 | Fed. Rep. of Germany | 92/33 |

*Primary Examiner*—Paul E. Maslousky

*Attorney, Agent, or Firm*—Seed and Berry

[57] ABSTRACT

Helically splined hydraulic actuator provided with hydraulic cushioning and rapid initiation of movement. The actuator is provided with an elongated cylindrical bearing integral with the shaft of the actuator for increasing radial and movement load-carrying capacity of the actuator without increasing its length.

8 Claims, 2 Drawing Figures

ROTARY HELICAL ACTUATOR

TECHNICAL FIELD

This application pertains to improvements in rotary helical actuators of the type in which linear reciprocatory movement of a piston by fluid pressure converts to rotary motion of an output member, either the shaft or cylinder, and particularly to rotary actuators in which the reciprocating-to-rotary conversion is through helical splines.

BACKGROUND ART

Rotary helical actuators are well known in the art. Basically, these devices apply pressurized fluid to opposite sides of a piston within a hydraulic cylinder. A shaft is rotatably supported within the cylinder. Motion of the piston through selective pressurization of opposite sides of the piston reciprocates the piston within the cylinder. Between the piston and the shaft are helically splined motion conversion means which take the reciprocatory movement of the piston and convert it to the rotary motion of either the shaft or the cylinder, depending on whether the shaft or cylinder is held stationary. Helical splines have the advantage of providing very high torques, and are useful for numerous applications, including articulating rock drill heads or combined pivots and actuators for swing booms on loaders and the like. For applications such as the combined pivot and actuator for swinging the boom of a front end loader, compactness and ability to carry high radial loads are essential. The space available for an actuator at the pivot of a swing boom is very limited. Therefore, the length of the actuator is confined to very short dimensions. This short axial length requirement and very high radial loading have limited the application of rotary actuators for pivots on the boom of a front end loader.

A second problem with actuators which must deliver high torque between the cylinder and the shaft of the actuator is that impacting of the piston at the extreme ends of its travel causes damage to the piston and cylinder. U.S. Pat. No. 4,015,728 discloses hydraulic cushioning valves, but the valves extend into the piston path and will become worn by impact with the piston.

DISCLOSURE OF INVENTION

It is an object of this invention to provide an improved bearing for carrying radial loads in a helically splined rotary actuator.

Basically, this object is obtained by providing the shaft of the actuator with a bolted on, welded or integral, axially extending, cylindrical bearing to withstand radial loading between the shaft and the cylinder and form a compartment for receiving the helically splined piston sleeve of the actuator.

An important feature of the preferred embodiment is the unique coaction between a separate, independent ring gear, the piston, and the cylindrical integral bearing with a highly finished, common cylindrical surface of the actuator. Basically, this feature provides greatly enhanced operation of the actuator while reducing manufacturing costs. By honing or finishing the actuator cylinder along its full operational length, three seating surfaces are provided: one for the piston seals, a second for accurately seating the ring gear, and the third for providing an ideal seating surface for the integral cylindrical bearing.

Another object of the invention is to provide improved hydraulic cushioning of the extreme ends of movement of the actuator.

Basically, this object is obtained by providing elongated axial fluid passages within the shaft and extending in communication with radial ports on opposite sides of the extreme length of the travel of the piston. These main ports are covered by the piston in each of its ends of travel so that as the piston approaches a radial port at either end of travel, it stops flow of hydraulic fluid being discharged from the cylinder. In the preferred embodiment, radial bypass ports are provided which are not covered by the piston. One of these bypass ports is provided with a one-way check valve which allows pressurizing fluid to free-flow into the cylinder for rapidly initiating movement of a piston when it is at one of its extreme ends of movement. Another bypass port has a limited diameter orifice for metering the fluid discharge for hydraulic cushioning.

BEST MODE FOR CARRYING OUT THE INVENTION

Figure 1:
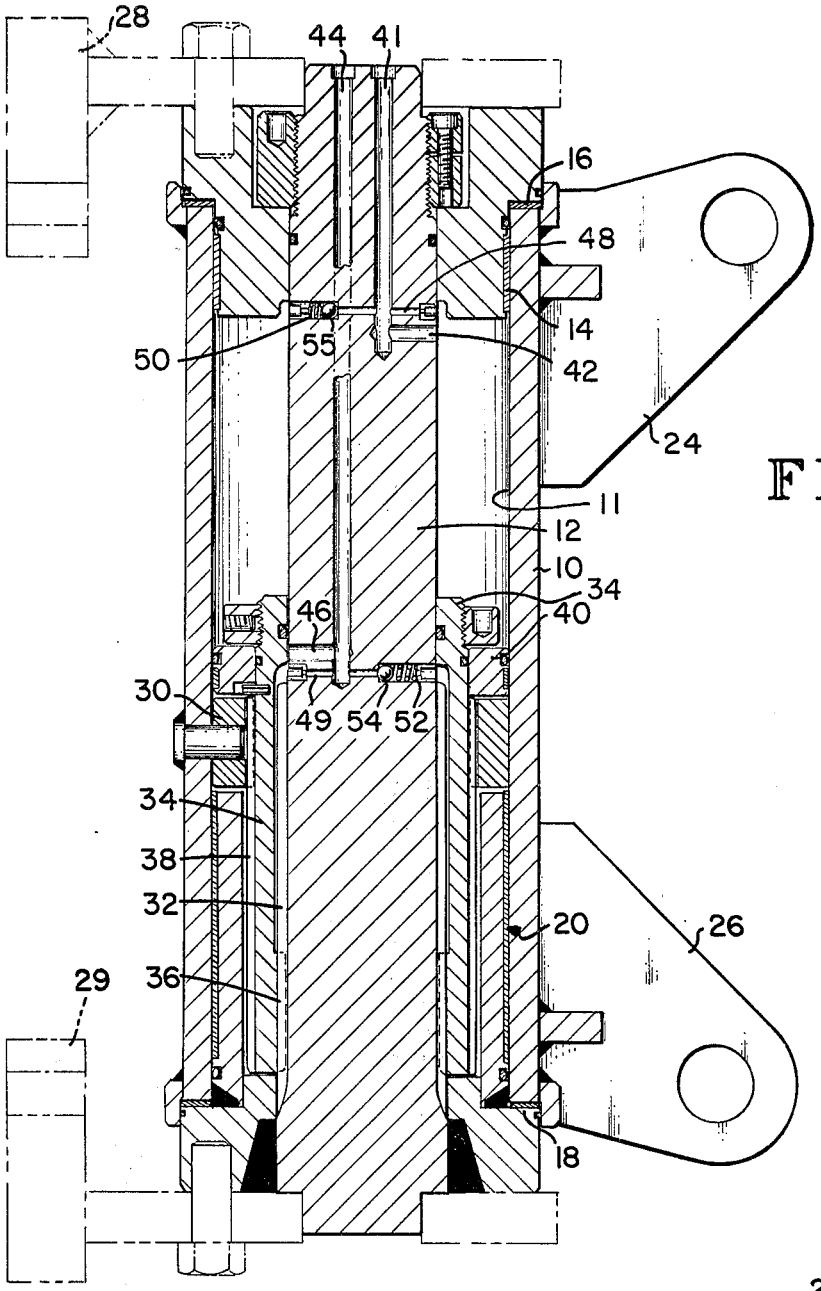
FIG. 1 is an axial section view of a helical actuator embodying the principles of the invention.
Figure 2:
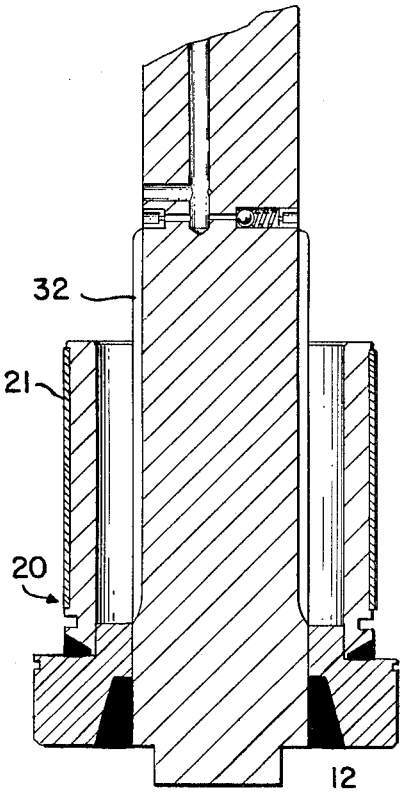
FIG. 2 is a fragmentary side elevation of a portion of the actuator shown in FIG. 1.

The actuator shown in the drawings includes an outer cylinder 10 and an inner shaft 12 which is rotatably mounted within the cylinder by first radial bearing 14, thrust bearing 16, a second thrust bearing 18 at the opposite end of the cylinder, and a unique radial bearing 20. The cylinder is provided with two sets of clevises 24 and 26. The shaft is provided with mounting brackets 28 and 29. As is well understood, the clevises 24 and 26 can be fastened to the movable part and the brackets 28 and 29 fastened to the stationary part. In this arrangement, the shaft will remain stationary and the cylinder rotated. In the alternative, however, the bracket 28 and 30 can be mounted to the rotatable part and the clevises 24 and 26 mounted to the stationary part. In this arrangement, the cylinder remains stationary and the shaft is rotated.

It is a unique feature of this invention that the radial bearing 20 is cantilevered as a part of the shaft 12. This bearing can be welded, bolted or machined onto the shaft. The bearing extends a substantial distance along the length of the shaft. The outer surface of the bearing is provided with a bearing material 21 which engages the inside surface of the cylinder, as shown in FIG. 1. The long length of the bearing and its large circumferential bearing capacity give the bearing a very high radial load-carrying capacity. Since the bearing extends inwardly from the end of the shaft and cylinder, however, the length of the cylinder is not substantially increased. This bearing uniquely provides greater than normal bearing surface within the confines of a very short actuator. The large size of the bearing also increases the capacity of the actuator to carry large moments, as are common when the actuator is used as a swing pivot actuator.

Within the gap provided between the bearing 20 and the shaft 12, reciprocating-to-rotary, helically splined motion conversion means are provided. While a single spline actuator can be provided, preferably the reciprocating-to-rotary motion conversion means includes a double helical spline actuator. Such a conversion mechanism includes a splined, independent ring gear 30 fixed to the cylinder and external splines 32 on the outer surface of the shaft 12. An elongated piston sleeve 34 is provided with an inner spline ring 36 that meshes with the splines on the shaft and outer splines 38 which mesh with the ring gear 30. A piston 40, with appropriate seals, is attached to the piston sleeve 34. As is well understood, fluid introduced below the piston (as viewed in FIG. 1) will cause the piston to raise in the cylinder, causing the shaft or cylinder to rotate. The fluid above the piston 40 will be discharged, with the rate of movement of the piston being determined by the narrowest orifice at the discharge port.

The separate ring gear, integral cantilevered bearing and piston uniquely combine with the inside cylindrical surface 11 of the cylinder 10. This surface is preferably honed to about a 32 RMS finish as a final machining step during fabrication. The smooth finish then provides an ideal seating surface for the bearing material 21, an accurate seat for the ring gear 30, and a good sealing surface for the sealing rings of the piston 40. Consequently, a synergistic effect is produced from the one honing operation, causing enhanced operation of the novel bearing and the separate ring gear and piston.

It is another unique feature of this invention that improved cushioning by hydraulic fluid at the extreme ends of movement of the piston is provided. Hydraulic fluid to lower the piston is passed through an axial passage 41 that communicates with a radial main port 42. Fluid to raise the piston is introduced through an axial passage 44 which communicates with a radial main port 46. As is best shown in FIG. 1, the piston sleeve 34 overlies and substantially closes off the port 46 when the piston approaches its lowermost position. This stops flow of fluid out of the port 46. In the upper extreme, the piston sleeve closes off the port 42. Bypass ports 48 and 49 have small diameter orifices to restrict hydraulic fluid flow, thus slowing the piston to provide hydraulic cushioning.

It is a unique feature of this invention that in addition to hydraulic cushioning, rapid initiation of movement of the piston from either of its extreme positions can still be accomplished. This is achieved by a secondary set of radial bypass ports 50 and 52, each provided with a check valve 54 and 55. The check valve allows pressurized fluid to pass into the cylinder but blocks fluid leaving the cylinder. The location of the secondary ports is out of the overlap position of the piston so that by pressurizing through one of the ports 50 or 52, full fluid flow can be provided to start or initiate movement of the piston. The restriction for hydraulic cushioning still is effective since the check valves render the port inactive during discharge of fluid.

While the preferred embodiments of the invention have been illustrated and described, the invention is not to be limited to the specific embodiments illustrated in the drawing. Variations will be apparent to those skilled in the art without departing from the principles herein.

I claim:

1. A rotary actuator comprising a cylinder, a shaft rotatably mounted within said cylinder for relative rotation between the shaft and the cylinder, linear-to-rotary motion conversion means between the shaft and cylinder, said motion conversion means including a piston, means for selectively introducing pressurized fluid to alternative sides of said piston for reciprocating the piston and producing said relative rotation, and bearing means for carrying the radial and bending loads between the shaft and cylinder, said bearing means including a cylindrical bearing sleeve joined to said shaft extending along the length of the shaft inward of said cylinder, and spaced radially from the outer surface of the shaft to define an operating chamber for receiving the motion conversion means, and said bearing sleeve having a radially outer bearing surface in engagement with the inner surface of the cylinder.

2. The actuator of claim 1, said motion conversion means including a helically splined ring joined to the inner surface of the cylinder, an elongated, cylindrical piston sleeve extending into said operating chamber and having said piston at one end and a cylindrical body, said shaft having an outer splined surface, said cylindrical body having helically splined inner and outer surfaces meshing respectively with said splined shaft surface and said helically splined ring.

3. The actuator of claim 1 or 2, said inner surface of said cylinder having a smooth finish extending at least through a bearing area, a ring gear area and a piston area, said smooth finish providing a bearing seat for said bearing sleeve radially outer bearing surface, said motion conversion means including an independent ring gear fixed to said cylinder, said smooth finish providing an accurate contact area for supporting said ring gear, said piston including sealing means, and said smooth finish providing a sealing surface for engagement by said piston sealing means wherein the combined smoothly finished areas coact with three different components of said actuator.

4. The actuator of claim 1, said shaft having at least two axial fluid passages and interconnected radial main ports for carrying fluid to opposite sides of said piston, and said main ports at opposite ends of said shaft overlapping the two extreme end positions of said piston, said piston being fitted to close off said main ports just prior to reaching its opposite extreme end positions whereby the fluid flow out of said ports is substantially stopped by first and second bypass ports communicating with said axial passage around each of said main ports, each of said first bypass ports including a check valve allowing free passage in the pressurizing direction for bypassing said piston blockage of said main ports to provide rapid movement of the piston initially in either direction, each of said second bypass ports having a restricted diameter orifice for limiting fluid flow for hydraulic cushioning.

5. An actuator comprising an outer cylinder, a shaft rotatably supported within the cylinder for relative rotational movement therebetween, a piston slidable in said cylinder, means for converting reciprocation of said pistion to rotary motion between said shaft and said cylinder, and hydraulic control means for guiding pressurized fluid into and out of said cylinder to opposite sides of said piston, said control means including axial passages in said shaft, radial main ports coupled to said passages and opening into said cylinder at opposite sides of the piston, said piston having a stroke which overlaps said ports at opposite extremes of movement whereby fluid discharging a port during movement of the piston becomes restricted in flow as the piston approaches an extreme of travel, said fluid control means including bypass ports adjacent each main port, said bypass ports being exposed to said cylinder in all positions of the piston movement, means in said bypass ports for allowing free flow when pressurizing the side of a piston for rapid initial movement of a piston from an extreme position, and means in said bypass ports for providing restricted flow of fluid discharging for providing hydraulic cushioning.

6. The actuator of claim 5, said bypass ports including two sets of ports, one set having small diameter orifices for restricting flow, the other set having check valves for allowing flow only into the cylinder.

7. A rotary actuator having an elongated cylinder, a shaft rotatably mounted in said cylinder, and reciprocating-to-rotary motion conversion means between the shaft and the cylinder, said motion conversion means including an independent ring gear fixed to said cylinder generally centrally of the axial length of the cylinder, said cylinder including an elongated, internal, smoothly finished surface, said shaft including an integral cylindrical bearing within said cylinder joined to said shaft and spaced radially therefrom, said motion conversion means including a piston coupled to a carrier that meshes with said ring gear wherein reciprocation of said piston will produce rotation of said shaft and cylinder relative to one another, said smoothly finished surface of said cylinder providing a seat for said cylindrical bearing, a seat for said ring and a seat for said piston.

8. The actuator of claim 1, 5, or 7 wherein the motion conversion means utilize helical splines.

* * * * *